United States Patent [19]

Dickson et al.

[11] 4,338,179

[45] Jul. 6, 1982

[54] ELECTRODE

[75] Inventors: Ronald Dickson, Bridgnorth; Michael R. Hampson, Brewood, both of England

[73] Assignee: Marston Excelsior Limited, Wolverhampton, England

[21] Appl. No.: 808,430

[22] Filed: Jun. 20, 1977

[30] Foreign Application Priority Data

Jun. 21, 1976 [GB] United Kingdom ..... 25637/76

[51] Int. Cl.[3] ..... C25B 11/03; C25B 11/10

[52] U.S. Cl. ..... 204/284; 204/288; 204/289; 204/290 F

[58] Field of Search ..... 204/252, 282, 288, 289, 204/284, 290 F

[56] References Cited

U.S. PATENT DOCUMENTS

| | | | |
|---|---|---|---|
| 3,215,609 | 11/1965 | Chapdelaine | 204/288 X |
| 3,674,676 | 7/1972 | Fogelman | 204/288 X |
| 4,028,214 | 6/1977 | Ford et al. | 204/288 X |
| 4,033,849 | 7/1977 | Pohto et al. | 204/288 X |

*Primary Examiner*—Donald R. Valentine

*Attorney, Agent, or Firm*—Cushman, Darby & Cushman

[57] ABSTRACT

A diaphragm cell electrode including a central current feeder and a pair of working faces welded along their central lines to the current feeder, the outer edges being unrestrained so as to be resiliently compressible and expandable.

7 Claims, 4 Drawing Figures

ELECTRODE

BACKGROUND OF THE INVENTION

This invention relates to electrodes and has particular reference to anodes for use in diaphragm or membrane cells.

It is well known to produce chlorine by the electrolysis of alkaline metal chlorides, particularly sodium chloride in diaphragm type electrolytic cells. Basically these cells comprise alternate anodes and cathodes which are separated by a diaphragm typically formed of asbestos. The diaphragm serves to separate the anolyte and the catholyte liquors. A more recent development is the membrane cell in which the diaphragm is replaced by a membrane permeable to one ion species only.

Initially the anodes for diaphragm cells were formed of graphite. More recently permanent metal anodes have been introduced, these normally being formed of titanium and having an anodically active surface layer on the titanium sheets. A typical diaphragm anode comprises an elongate current feeder—normally a copper cored titanium bar—to which is spot-welded two titanium sheets of open mesh construction. The two sheets are arranged parallel to one another on opposite sides of the current feeder. Around part of the periphery the two sheets are joined together to form an open box type structure.

A more recent development of a diaphragm cell anode is described in British Pat. No. 1326673 (and in its equivalent U.S. Pat. No. 3,674,676). This patent describes the adjustable diaphragm cell anode structure in which the connection between the feeder and the anode working faces or sheets is movable so that the distance between the two opposed sheets can be varied whilst retaining the electrical integrity of the assembly. The adjustability is most clearly shown in FIG. 6 of the British patent.

In practice, however, it has been found that a number of problems are associated with adjustable anodes of this type. Because the anodes are quite tall—usually about 2 ft tall—and because the distance between the faces is quite small—usually about 1-2 in—it is difficult to adjust the thickness of the anode and at the same time to make effective mechanical electrical connections within the anode once it is installed in the diaphragm cell. It is not normally practical to adjust the anode to its final size before insertion into the cell because of the dangers of damaging the diaphragm. A further problem is that once adjusted the anode is of fixed dimensions and any deterioration in the diaphragm can cause the diaphragm to be moved away from the anode and thereby increase the electrical resistivity of the cell.

In an attempt to overcome the problems associated with the arrangement illustrated in FIG. 6 alternative forms of construction are illustrated in FIGS. 4 and 5 of the aforementioned British patent specification. With such an arrangement, however, it is necessary to insert spacer bars such as bars 17 (FIGS. 3 and 5 of the aforementioned British patent specification) to space out the anode working faces. Because of the constrictions within the diaphragm or membrane cell this is an added complication on assembly.

An alternative proposal in the aforementioned British patent specification is illustrated in FIGS. 8 and 9. In this arrangement the anode working surfaces are connected to the central current feeder by means of spring members. The anode can be assembled outside the cell with the working surfaces contracted and on insertion the clips holding the working surfaces together are removed permitting the anode working faces to spring outwardly. Because of the movement on expansion it is necessary to provide a gap between halves of the working surface and the gap is shown clearly by reference numeral 39 in FIG. 8. This gap does, however, form a potential source of damage to the diaphragm or membrane since it might pinch the diaphragm or membrane and possibly pierce it. Also the construction illustrated in FIGS. 8 and 9 is complex to make and, therefore, relatively expensive. There is a further problem associated with anodes of this type in that even if the sheets facing the diaphragm, ie the working sheets, are made continuous without a gap there is still a problem of the connecting spring between the central conductor and the working faces. From the point of view of resilience it is desired to use thin spring members. However, these have a low conductivity and can cause overheating problems. If the spring members are thickened to increase the electrical conductivity they become less effective as spring members.

By film-forming or valve metal as used herein is meant a metal chosen from the group titanium, zirconium, niobium, hafnium or tantalum or an alloy of one or more of these metals having comparable anodic properties. By anodically active material is meant a material capable of operating as an anode, of passing an electrical current without passivating and without rapidly dissolving.

SUMMARY OF THE INVENTION

By the present invention there is provided an electrode intended for use in a diaphragm or membrane cell having a gap of a given width between adjacent diaphragms or membranes, having an elongate current feeder and at least two continuous or foraminate electrode sheets in electrical contact with the current feeder, characterised in that the electrode sheets over a substantial area are wider apart in the free condition than the dimensions of the gap, and in that they are moved inwardly to be inserted into the gap, to be released and spring outwardly and be resiliently biassed in the direction of the diaphragm or membrane when in use.

The present invention further provides an electrode for use in a diaphragm or membrance cell having a gap of given dimensions between adjacent diaphragms or membranes for the insertion of the electrode, the electrode having a current feeder and at least two opposed electrode faces, characterised in that the electrode faces are permanently fixed to the current feeder, are over a substantial area spaced further apart than the width of the gap and in that the electrode faces are resiliently movable towards and away from one another.

The present invention further provides an adjustable anode for a diaphragm or membrane cell including an elongate current feeder and a pair of anode working faces permanently fixed to the feeder, the edges of the faces being resiliently biassed away from one another so that, in use, the faces are resiliently biassed towards the diaphragm or membrane.

The present invention further provides an anode assembly including an elongate current feeder, two opposed electrode sheets welded to the feeder along a substantially central line of the sheets, at least one of the sheets lying in at least two different planes which intersect at or near the current feeder.

The present invention further provides an anode assembly which includes an elongate current feeder in permanently fixed contact with at least two opposed foraminate or continuous film-forming metal electrode sheets, the sheets being splayed outwardly from the current feeder so that, in use, when located in a diaphragm or membrane type cell, they are resiliently biassed towards the diaphragm or membrane.

The present invention further provides an electrolytic cell of the diaphragm or membrane type incorporating an anode having a pair of resiliently biassed working faces permanently connected to and on opposite sides of an elongate current feeder, the faces being resiliently biassed in use into contact with the diaphragm or membrane separating the anode from the cathode.

The working faces preferably are formed from film-forming metal and have an anodically active coating thereon. Any suitable coating may be used.

The elongate current feeder is preferably in the form of a titanium tube having a core of a material having a higher electrical conductivity preferably copper or aluminium.

The working faces may be resiliently biassed outwardly by means of an internal member.

The electrode sheets or faces are preferably in the form of foraminate titanium. The free edges are unconnected; they may be turned inwardly to form an inwardly directed channel. In use a clip may be used to connect the channels to ease insertion of the anodes into a diaphragm cell, the clip being removed to permit the faces to spring outwardly.

BRIEF DESCRIPTION OF THE DRAWINGS

By way of example embodiments of the present invention will now be described with reference to the accompanying drawings of which.

DESCRIPTION OF THE PREFERRED EMBODIMENTS

Figure 1:
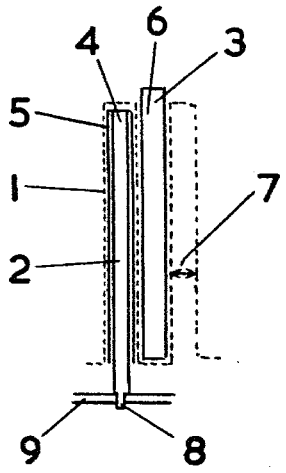
FIG. 1 is a schematic cross-section of a diaphragam cell.
Figure 2:
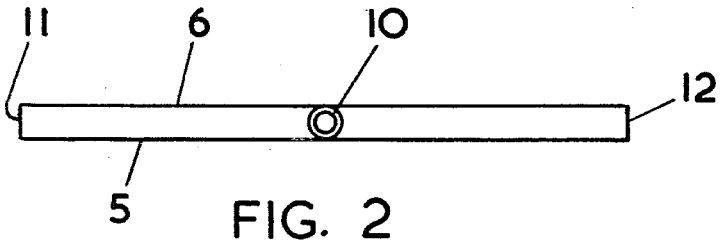
FIG. 2 is a plan view of a conventional diaphragm cell anode.
Figure 4:
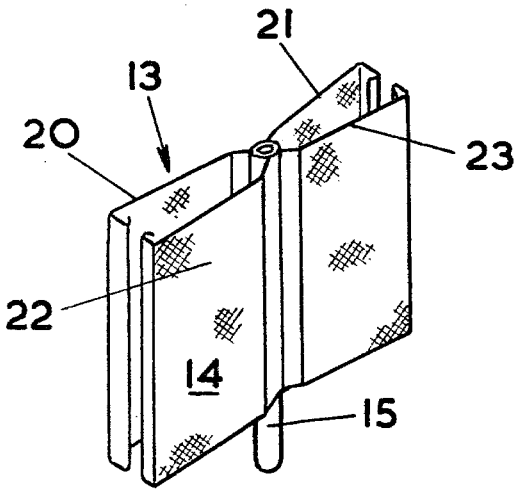
FIGS. 3 and 4 are plan and perpendicular views of one embodiment of the invention.

Referring, initially, to FIG. 1 the drawing illustrates part of a conventional diaphragm cell in which there is a diaphragm 1 separating an anode 2 and a cathode 3. The anode 2 comprises a central copper cored titanium current feeder 4 having a pair or titanium mesh surfaces 5,6 covered with a suitable anodically active material. The cathode is normally formed of steel and the diaphragm is conventionally formed of asbestos impregnated onto a suitable supporting cathode mesh. The anode 2 fits into the fixed gap 7 of predetermined width between adjacent diaphragms. Current is fed to the anode through the bottom of the anode 8 which is fixed in a suitable manner to a base 9.

In plan view the conventional anode of the prior art is formed by spot welding two sheets 5 and 6 to the outer sheath 10 of a copper cored titanium current feeder. The ends of the sheets 5 and 6 are joined together by means of end strip turnovers or channels 11 and 12. The conventional anode of the prior art was of fixed dimensions and fitted loosely within the predetermined gap 7 in the diaphragms.

Figure 3:
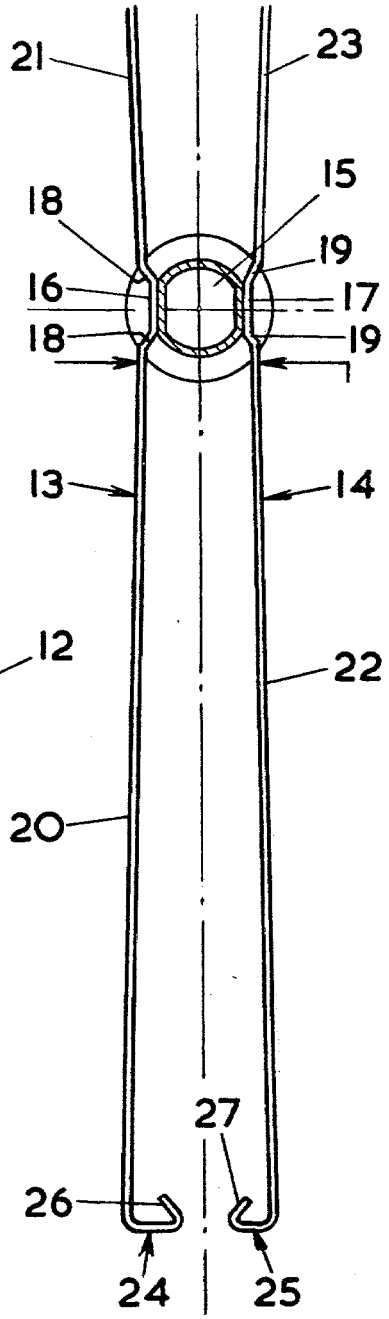

One embodiment of the invention is shown in FIG. 3. Again current is fed to the anode faces 13,14 by means of a copper cored titanium current feeder 15. The sheets 13 and 14 are of splayed shape in plan view having a central ridge 16,17 with two portions angled outwardly at 18,19 and then planar portions 20, 21, 22 and 23 integral with the ridges 16,17 and the portions 18,19. Each of the faces 20, 21, 22 and 23 lies in a single plane but the four planes differ and the planes of the faces 20 and 21 intersect in a line near the elongate current carrying post 15. The distal edges 24,25 of the portions 20 and 22 are free to move and are spaced at a greater distance apart than the edges nearest the portions 18,19. The edges 24 and 25 are also turned inwardly to form channel sections 26 and 27.

The distance apart of the ends 24 and 25 is greater than the gap width 7 and to insert the anodes a U-shaped member is inserted up into the channels 26 and 27 to hold the ends together. Once the anode has been inserted into the diaphragm the U-shaped member is removed allowing portions 20 and 22 to spring outwardly into contact with the diaphgram. To assist in the outward movement of the anode working faces an internal spring may be inserted between the portions 20 and 22, 21 and 23. In a modification of the invention a solid member may be used to force out the anode working faces without giving any resilient bias once the faces are spread out.

With the anode of the invention the permanent resilience on the working faces means that they can be permitted to come into contact with conventional unmodified asbestos diaphragms. As the diaphragms swell the anode working faces move to maintain a constant diaphragm anode gap, the gap normally being defined by suitable inner spacing members.

Because the resilience of the anode working surfaces is obtained over their entire length and width the stresses imposed are low and the assembly can be easily manufactured. The construction of the anode also permits higher operating efficiencies because it removes or reduces the unwanted diaphragm to anode gap.

The significant feature of the invention, ie the provision of the working surface connected directly to the current feeder and in particular in the case in which the current feeder is in the centre of four halves of the anode working surfaces, is that it enables a very simple and continuous anode to be manufactured which is easy to insert, which does not damage the diaphragm or membrane, which is easily manufactured and has a high electrical efficiency. The electrical efficiency has two components, firstly that there is a direct electrical linkage between the current feeder and the working face and secondly the resilience of the working faces enables the anode to diaphragm or membrane to be minimised.

We claim:

1. An anode for use in a diaphragm or membrane cell comprising an elongate current feeder post and a pair of spaced electrode sheets disposed on either side of the current feeder post and being directly welded to the post along their center lines, the sheets being resiliently movable toward one another and resiliently springable outwardly, each of the electrode sheets comprising a central web portion and an integral substantially planar portion on each side of the web portion, an anodically active outer layer on at least part of the surface of the planar portions, the two web portions being directly attached to opposite sides of the current feeder post and each including two flange portions which are splayed outwardly from the current feeder post and are integral with the substantially planar portions of the electrode sheets, in the unconstrained condition the two adjacent free edges of the substantially planar portions of the two sheets being spaced wider apart than the parts of the planar portions closest to the connection line with the flanges.

2. An anode for use in a diaphragm or membrane cell comprising an elongate current feeder post and a pair of spaced electrode sheets, each sheet having a central vertically extending groove, the roots of each groove being welded on opposite sides to the elongate current feeder in back-to-back relationship, the free edges of the sheets being resiliently movable toward one another and resiliently springable outwardly, an anodically active outer layer on at least part of the surface of the sheets, the arrangement being such that in the unconstrained condition the two adjacent free edges of the substantially planar portions of the two sheets are spaced wider apart than the parts of the sheets closest to the groove.

3. An electrode as claimed in claim 1 or claim 2 wherein the sheets are of foraminate titanium.

4. An electrode as claimed in claim 1 or claim 2 wherein the elongate current feeder is in the form of a titanium tube having a core of material which has a higher conductivity.

5. An electrode as claimed in claim 1 or claim 2 wherein the elongate current feeder is in the form of a titanium tube having a core of copper or aluminium.

6. An electrode as claimed in claim 1 or claim 2 wherein the free edges of the sheets are turned inwardly to form an inwardly directed channel.

7. An electrode as claimed in claim 1 or claim 2 wherein the sheets are fusion welded or spot welded to the elongate current feeder.

* * * * *

UNITED STATES PATENT AND TRADEMARK OFFICE

CERTIFICATE OF CORRECTION

PATENT NO. : 4,338,179

DATED : July 6, 1982

INVENTOR(S) : DICKSON et al

It is certified that error appears in the above-identified patent and that said Letters Patent is hereby corrected as shown below:

Title page:

Delete "[73] Assignee: Marston Excelsior Limited, Wolverhampton, England"

Signed and Sealed this

Twenty-second Day of September, 1987

*Attest:*

DONALD J. QUIGG

*Attesting Officer* *Commissioner of Patents and Trademarks*